US009695546B2

(12) United States Patent
Lee

(10) Patent No.: US 9,695,546 B2
(45) Date of Patent: Jul. 4, 2017

(54) DRYING ASSEMBLY AND MANUFACTURING METHOD FOR THE SAME

(71) Applicant: Dongbu Daewoo Electronics Corporation, Seoul (KR)

(72) Inventor: Sung Myun Lee, Seoul (KR)

(73) Assignee: DONGBU DAEWOO ELECTRONICS CORPORATION, Seoul (KR)

( * ) Notice: Subject to any disclaimer, the term of this patent is extended or adjusted under 35 U.S.C. 154(b) by 1 day.

(21) Appl. No.: 14/981,639

(22) Filed: Dec. 28, 2015

(65) Prior Publication Data

US 2016/0369450 A1 Dec. 22, 2016

(30) Foreign Application Priority Data

Jun. 18, 2015 (KR) ..... 10-2015-0086876

(51) Int. Cl.
*D06F 58/24* (2006.01)

(52) U.S. Cl.
CPC ..... *D06F 58/24* (2013.01)

(58) Field of Classification Search
CPC ..... F26B 11/00; F26B 21/00; D06F 58/00; D06F 58/12; D06F 58/24
USPC ..... 34/595, 576, 610
See application file for complete search history.

(56) References Cited

U.S. PATENT DOCUMENTS 2,868,004 A * 1/1959 Runde ..... D06F 25/00 137/624.2
5,168,621 A * 12/1992 Kruck ..... A47L 15/4251 264/515
7,355,315 B2 * 4/2008 Ju ..... D06F 37/304 310/261.1
7,748,242 B2 * 7/2010 Saito ..... D06F 37/04 68/140
7,785,098 B1 * 8/2010 Appleby ..... B29C 33/302 264/319
7,802,377 B2 * 9/2010 Kloibhofer ..... D21F 5/027 126/400
7,886,391 B2 * 2/2011 Shikamori ..... D06F 17/06 68/12.24
8,209,881 B2 * 7/2012 Lee ..... D06F 58/04 165/10

(Continued)

FOREIGN PATENT DOCUMENTS

JP 01005518 A * 1/1989
KR 10-0184189 B1 5/1999

(Continued)

*Primary Examiner* — Stephen M Gravini

(57) ABSTRACT

A dryer including an air condensing unit that can use cooling water to reduce air moisture by condensation in a non-contact manner. The air condensing unit includes a condensing duct and a hollow rib enclosed inside the condensing duct. During a drying process, cooling water flows through the hollow rib and, at the same time, air coming from the tub flows through the hollow rib and is cooled off by the cooling water. The cooled air exits the condensing duct and flows back to the tub after travelling through a drying duct that includes a heater. The external wall and/or internal wall of the rib has protrusions and depressions formed in a three-dimensional pattern to increase surface area.

20 Claims, 7 Drawing Sheets

(56) References Cited

U.S. PATENT DOCUMENTS

| | | | | |
|---|---|---|---|---|
| 8,789,287 | B2 * | 7/2014 | Kim | D06F 58/22 34/480 |
| 9,040,145 | B2 * | 5/2015 | Lyons | B32B 5/16 428/141 |
| 9,133,575 | B2 * | 9/2015 | Hong | D06F 25/00 |
| 9,163,352 | B2 * | 10/2015 | Han | D06F 58/26 |
| 9,206,309 | B2 * | 12/2015 | Appleby | B22C 9/04 |
| 9,285,695 | B2 * | 3/2016 | Miki | G03G 9/0935 |
| 9,315,663 | B2 * | 4/2016 | Appleby | C08L 63/00 |
| 9,335,095 | B2 * | 5/2016 | Bison | D06F 39/12 |
| 9,365,966 | B2 * | 6/2016 | Kim | D06F 37/268 |
| 9,453,295 | B2 * | 9/2016 | Bae | D06F 35/002 |
| 2007/0101602 | A1 | 5/2007 | Bae et al. | |
| 2014/0227411 | A1 * | 8/2014 | Popeil | A47J 37/1209 426/302 |
| 2016/0369450 | A1 * | 12/2016 | Lee | D06F 58/24 |

FOREIGN PATENT DOCUMENTS

| | | | | |
|---|---|---|---|---|
| KR | 20020093470 | | 12/2002 | |
| KR | 20020095370 | | 12/2002 | |
| KR | 10-2004-0047994 | A | 6/2004 | |
| KR | WO 2005124006 | A1 * | 12/2005 | D06F 17/06 |
| KR | 10-0640787 | | 10/2006 | |
| KR | 10-2012-0073582 | | 7/2012 | |
| KR | 10-2012-0073583 | | 7/2012 | |
| KR | EP 1759049 | B1 * | 8/2016 | D06F 17/06 |

* cited by examiner

DRYING ASSEMBLY AND MANUFACTURING METHOD FOR THE SAME

CROSS-REFERENCE TO RELATED APPLICATIONS

This application claims priority to and benefit of Korean Patent Application No. 10-2015-0086876, filed on Jun. 18, 2015, the disclosure of which is incorporated herein in its entirety by reference.

TECHNICAL FIELD

The present disclosure relates to dryers, and more particularly, to air flow path configurations in dryers.

BACKGROUND OF THE INVENTION

In general, a drum-type washing machine has the dual functions of washing and drying laundry.

FIG. 1 shows a configuration a drum-type washing machine. It includes a dryer 30 configured to capture moist air from a tub 20 and return high-temperature and dry air back into the tub 20. The tub 20 includes a drum 21 for accommodating laundry.

The dryer 30 includes a condensing duct 40 with one side coupled to the tub 20; a blast fan 50 coupled to the other side of the condensing duct 40; and a drying duct 60 with one side coupled to the condensing duct 40 via the blast fan 50 and the other side coupled to the tub 20. The drying duct 60 includes a heater 70 embedded therein. The moist air in the tub 20 is captured into the condensing duct 40 and is condensed and turned into low-temperature dry air. The condensed low-temperature dry air is transformed into high-temperature dry air by the heater 70 within the drying duct 60. The high-temperature dry air is then introduced into the drying duct 60 via the blast fan 50 and supplied back to the tub 20.

FIG. 2 is a diagram illustrating the configuration of a condensing duct 40 in a conventional drum-type washing machine 10 shown FIG. 1. Damp air flows from the tub 20 to the condensing duct 40 through an inlet 41 and comes into contact with cooling water flowing in the condensing duct 40. The damp air is cooled off by the cooling water and thus condensed. The damp air with reduced humidity is discharged to the drying duct 60 through an outlet 42 and the blast fan 50.

In the condensing duct having the above-described structure, the contact time between the air and the cooling water may not be long enough to allow the air to be condensed sufficiently. To solve this problem, Korean Patent Laid-open publication No. 10-2012-0073583 discloses a technique of improving the drying effect by providing a bypass to increase a contact time between air flowing within the condensing duct and cooling water supplied into the condensing duct. The drawback to this technique is that the air and the cooling water come into direct contact with each other, and the cooling water may be drawn into the drying duct when the air is sucked into the drying duct from the condensing duct by the blast fan. However, the cooling water vapor may cause unwanted corrosion of various components, such as the blast fan, the drying duct and other components. Furthermore, the vapor may return to the tub through the blast fan and the drying duct and consequently counteract the drying efficiency.

SUMMARY OF THE INVENTION

Embodiments present disclosure provide a drying assembly capable of improving drying effect by increasing a contact area between air and cooling water while adopting a non-contact type drying mechanism. The air and the cooling water do not come into direct contact with each other. Thus, the drying assembly and adjacent components can be protected from being corroded by water vapor. Further, the present disclosure also provides a manufacturing method for the drying assembly.

However, the problems sought to be solved by the present disclosure are not limited to the above description and other problems can be clearly understood by those skilled in the art from the following description.

In accordance with an exemplary embodiment of the present disclosure, there is provided a drying assembly, comprising a tub which contains wash water therein, a condensing duct coupled to one side of the tub and having therein an empty space through which air flows, an air inlet opening which is provided at one side of the condensing duct coupled to the tub, and through which the air is introduced into the condensing duct, an air outlet opening which is provided at the other side of the condensing duct opposite from the one side coupled to the tub, and through which the air is discharged out of the condensing duct, a blast fan provided at the other side of the condensing duct where the air outlet opening is provided, a drying duct one side of which is coupled to the blast fan and the other side of which is coupled to the tub, a heater provided within the drying duct; and a rib provided within the condensing duct and having therein a cavity into which the cooling water is introduced, wherein at least one of an external wall surface and an internal wall surface of the rib is formed to have a three-dimensional pattern to increase a surface area.

In this embodiment, the rib has a spiral shape.

In this embodiment, the three-dimensional pattern may be a repeated wave pattern or a repeated rectangular groove pattern.

In this embodiment, the rib may further include an inlet through which the cooling water is introduced into the cavity and an outlet through which the cooling water is discharged out of the cavity.

In this embodiment, the drying assembly may further comprise a cooling water storage unit including a storage tank for storing the cooling water therein, a cooling water injection port and a cooling water discharge port, wherein the cooling water is supplied into the cavity within the rib from the storage tank through the cooling water injection port which is coupled to the inlet of the rib, and the cooling water is discharged out into the storage tank from the cavity within the rib through the cooling water discharge port which is coupled to the outlet of the rib.

In accordance with another exemplary embodiment of the present disclosure, a manufacturing method for a drying assembly comprises installing a rib having a cavity therein, and provided with an inlet through which cooling water is introduced into the cavity and an outlet through which the cooling water is discharged out of the cavity, and having an external wall surface and an internal wall surface at least one of which is formed to have a three-dimensional pattern to increase a surface area, installing a condensing duct having an empty internal space in which the rib is installed, and provided with an air inlet opening through which air is introduced and an air outlet opening through which the air is exhausted, connecting a tub to one side of the condensing duct where the air inlet opening is provided, and connecting a blast fan to the other side of the condensing duct where the air outlet opening is provided, and connecting one side of a drying duct equipped with a heater to the blast fan and the other side to the tub.

In this embodiment, the rib may be formed to have a spiral shape.

In this embodiment, the three-dimensional pattern may be a shape of a wave or a shape of projections.

In this embodiment, the manufacturing method may further comprise installing a cooling water storage unit which includes a storage, a cooling water injection port and a cooling water discharge port and is configured to circulate the cooling water through the cavity within the rib and installing the cooling water injection port to the inlet of the rib, and connecting the cooling water discharge port to the outlet of the rib.

According to the exemplary embodiment of the present disclosure, by adopting the non-contact type drying mechanism in which the air and the cooling water do not come into direct contact with each other, the drying assembly and components around it can be protected from being corroded by moisture, and drying efficiency can be improved.

The foregoing is a summary and thus contains, by necessity, simplifications, generalizations and omissions of detail; consequently, those skilled in the art will appreciate that the summary is illustrative only and is not intended to be in any way limiting. Other aspects, inventive features, and advantages of the present invention, as defined solely by the claims, will become apparent in the non-limiting detailed description set forth below.

BRIEF DESCRIPTION OF THE DRAWINGS

Embodiments of the present invention will be better understood from a reading of the following detailed description, taken in conjunction with the accompanying drawing figures in which like reference characters designate like elements and in which.

DETAILED DESCRIPTION

Figure 1:
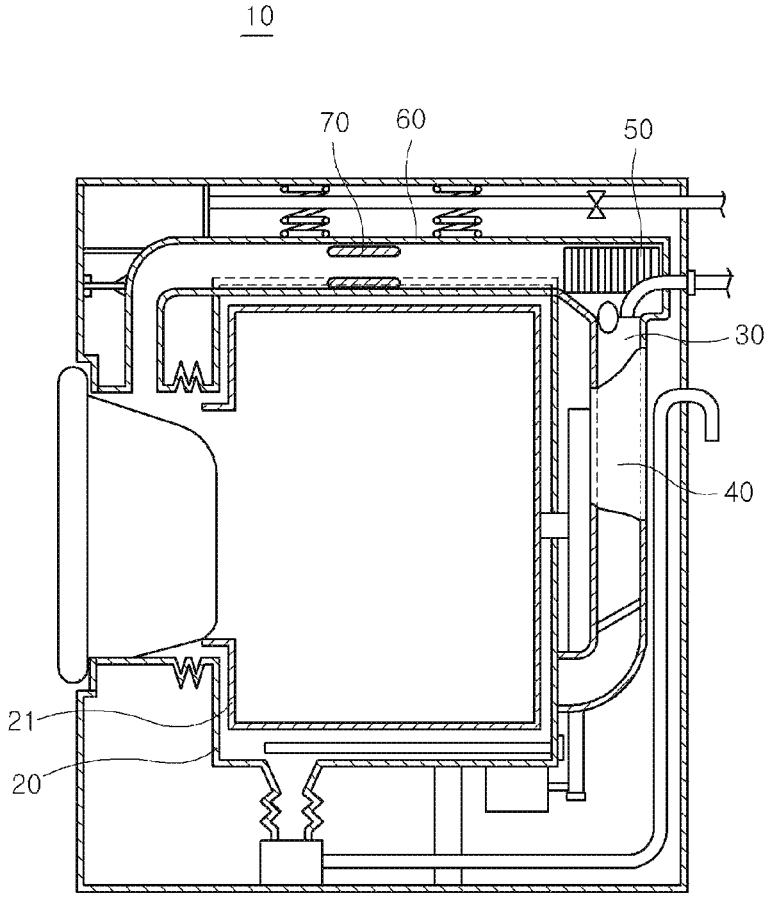
FIG. 1 (RELATED ART)
FIG. 1 shows a configuration a conventional drum-type washing machine.
Figure 2:
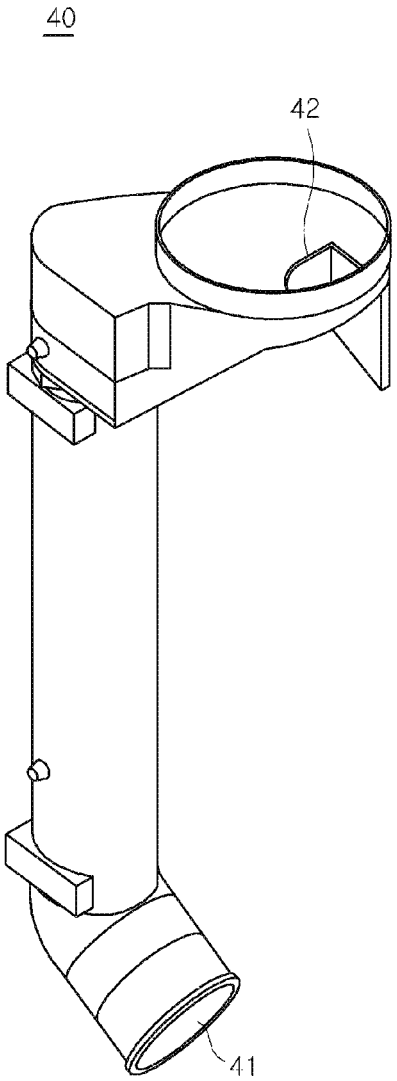
FIG. 2 (RELATED ART)
FIG. 2 is a diagram illustrating the configuration of a condensing duct 40 in the conventional drum-type washing machine shown FIG. 1.

Reference will now be made in detail to the preferred embodiments of the present invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of embodiments of the present invention, numerous specific details are set forth in order to provide a thorough understanding of the present invention. However, it will be recognized by one of ordinary skill in the art that the present invention may be practiced without these specific details. In other instances, well-known methods, procedures, components, and circuits have not been described in detail so as not to unnecessarily obscure aspects of the embodiments of the present invention. The drawings showing embodiments of the invention are semi-diagrammatic and not to scale and, particularly, some of the dimensions are for the clarity of presentation and are shown exaggerated in the drawing Figures. Similarly, although the views in the drawings for the ease of description generally show similar orientations, this depiction in the Figures is arbitrary for the most part. Generally, the invention can be operated in any orientation.

Drying Assembly and Manufacturing Method for the Same

Figure 3:
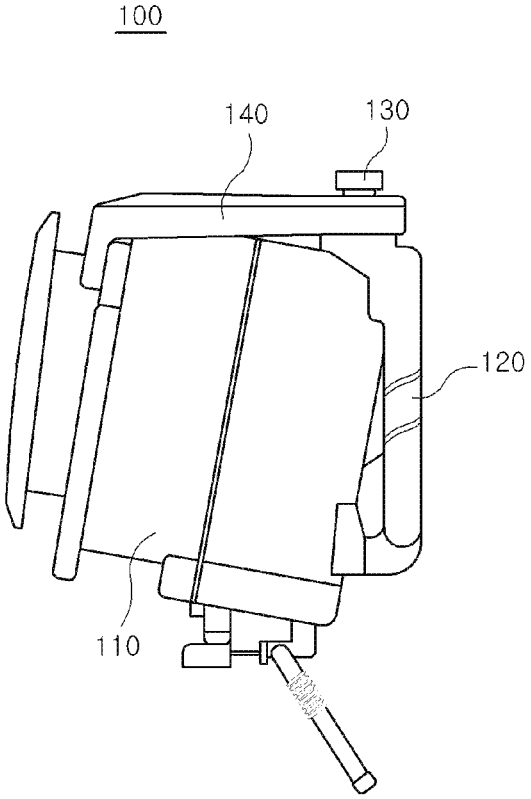
FIG. 3 illustrates the configuration of an exemplary drying assembly according to an embodiment of the present disclosure.
Figure 4:
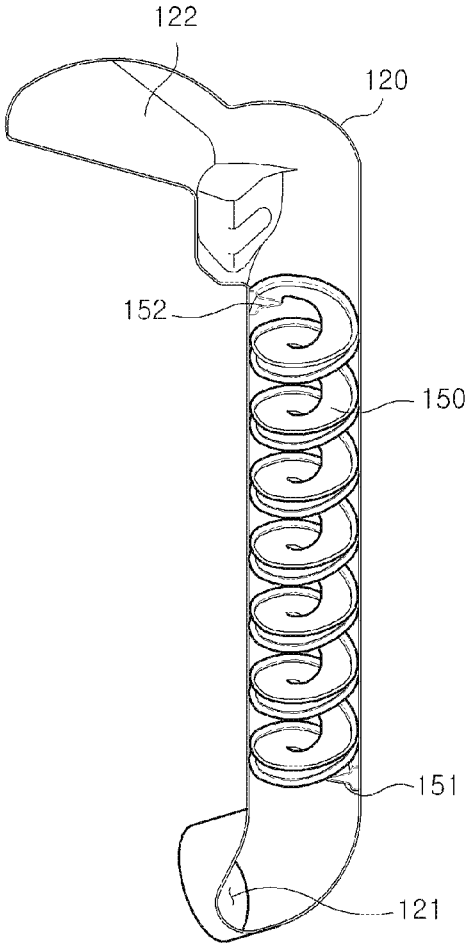
FIG. 4 illustrates an exemplary condensing duct enclosing a rib according to an embodiment of the present disclosure.

FIG. 3 illustrates the configuration of an exemplary drying assembly according to an embodiment of the present disclosure. FIG. 4 illustrates an exemplary condensing duct 120 of the drying assembly in FIG. 3 with a rib 150 according to an embodiment of the present disclosure.

Referring to FIG. 3 and FIG. 4, the drying assembly 100 includes a tub 110, the condensing duct 120, a blast fan 130, a drying duct 140, a heater (not shown) and the rib 150. During operation, the tub 110 contains wash water. A drum (not shown) for accommodating laundry therein is disposed within the tub 110.

The condensing duct 120 has a hollow structure and has an air inlet opening 121 directing to the tub 110 and an air outlet opening 122 directing to the blast fan 130. Damp air flows from the tub through the condensing duct 120 where it is converted to low-temperature dry air through condensation by cooling water. The low-temperature dry air is then discharged to the drying duct 140 via the blast fan 130.

The blast fan 130 and the tub 110 are coupled to opposite sides of the condensing duct 120. The blast fan 130 is configured to discharge the low-temperature dry air from the condensing duct 120 to the drying duct 140.

The drying duct 140 has one side coupled to the blast fan 130 and the other side coupled to the tub 110. The drying duct 140 is configured to convert the low-temperature dry air introduced by the blast fan 130 into high-temperature dry air and then discharge the high-temperature dry air into the tub 110.

A heater (not shown) may be embedded in the drying duct 140 and serve to heat the air.

The rib 150 is hollow and disposed inside the condensing duct 120 and allows the cooling water to flow through. The rib 150 has an inlet 151 on one end for introducing the cooling water into its cavity 153 and an outlet 152 on the other hand for discharging the cooling water. The rib 150 may include a three-dimensional pattern formed on a wall surface, which advantageously enlarges the heat exchange area between the cooling water and the air.

The operation of the drying assembly 100 according to an embodiment of the present disclosure is described as follows. Moist air within the tub 110 is drawn into the condensing duct 120 by the blast fan 130 and condenses into low-temperature dry air through heat transfer with cooling water present inside the condensing duct 120. The condensed low-temperature dry air is driven into the drying duct 140 by the blast fan 130 and turned into high-temperature dry air by the heater (not shown) inside the drying duct 140. The blast fan 130 then draws the high-temperature dry air from the drying duct 140 back into the tub 110.

Figure 5A:
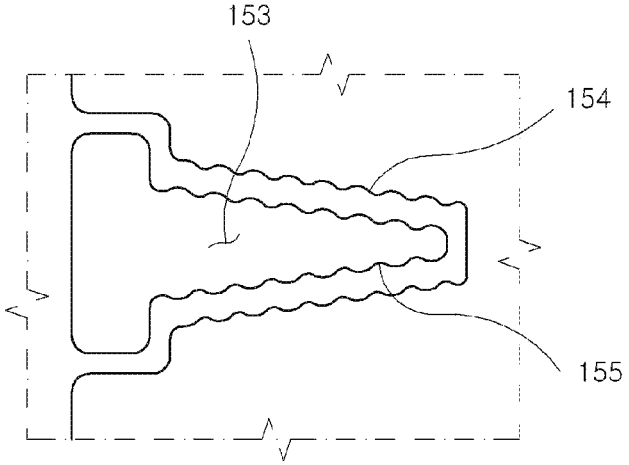
FIG. 5A and FIG. 5B are cross sectional views of exemplary ribs disposed inside the condensing duct of FIG. 3 and FIG. 4 according to embodiments of the present disclosure.
Figure 5B:
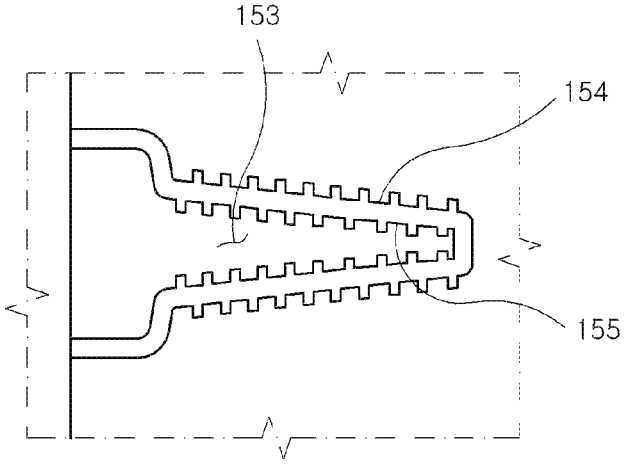

FIG. 5A and FIG. 5B shows cross sectional views of exemplary ribs disposed within the condensing duct of FIG. 3 and FIG. 4 according to embodiments of the present disclosure.

Referring to FIG. 4 and FIGS. 5A-5B. Damp air is introduced into the condensing duct 120 through its air inlet opening 121 and exchanges heat with cooling water flowing inside the rib 150 in a non-contact manner. That is, the air and the cooling water exchange heat with each other while the air is in contact with an external wall surface 154 of the rib 150 and the cooling water is in contact with an internal wall surface 155 of the rib 150. As a result, the temperature of the air can decrease. The cooled air can contain less moisture compared to the air before being subjected to the cooling. Thus, the cooled air becomes dry. The low-temperature dry air obtained through this condensation process is then discharged into the drying duct 140 through the air outlet opening of the condensing duct 120. Since the cavity 153 within the rib 150 in which the cooling water flows is isolated from the inside of the condensing duct 120 in which the air flows, the blast fan 130 does not draw the cooling water into the drying duct 140 when it draws the air from the condensing duct 120 into the drying duct 140. As air flowing through the condensing duct does not encounter water vapor generated from the cooling water, the overall drying efficiency of the dryer can be improved. Furthermore, the blast fan 140, the drying duct 140 and their adjacent components remain protected from corrosion that would have been caused by water vapor in the conventional art, as described above.

Particularly, as depicted in FIG. 5A and FIG. 5B, at least one of the external wall surface 154 and the internal wall surface 155 of the rib 150 have surface depressions and protrusions to enlarge the surface area. The protrusions or depressions may form a three-dimensional pattern, regular or irregular. The present disclosure is not limited by the number, size, shape, pattern of the protrusions and depressions and a rib. FIG. 5A shows a wave pattern formed on both the internal and external wall surface 155 and 154. FIG. 5B shows a rectangular groove pattern formed on both the internal and external wall surface 155 and 154.

According to embodiments of the present disclosure, a three-dimensional patterned external wall surface 154 can increase the contact area between the air flowing within the condensing duct 120 and the external wall surface 154, as opposed to a wall surface without such a pattern. Similarly, a three-dimensional patterned internal wall surface 155 can increase the contact area between the cooling water flowing within the cavity 153 in the rib 150 and the internal wall surface 155. As a result, a heat exchange area is increased, and drying efficiency is improved.

In some embodiments, the rib 150 has a spiral shape, as shown in FIG. 4. With this spiral shape, a heat exchange area between the cooling water flowing inside the rib 150 and the air flowing inside the condensing duct 120 can be increased, so that drying efficiency can be improved. In addition, the spiral shape prolongs heat exchange time, which further contributes to drying efficiency.

In this embodiment, the condensing duct 120 of FIG. 4 has the air inlet opening 121 on its lower portion and the air outlet opening 122 on its upper portion. In this configuration, the air flows upward (from the lower end of the condensing duct 120 toward the upper end) is impeded by its gravity, which further prolongs the time for the air travelling through the condensing duct 12. Thus, the heat exchange time between the air and the cooling water inside the rib 150 also increases. As a result, drying efficiency can be further improved.

Figure 6:
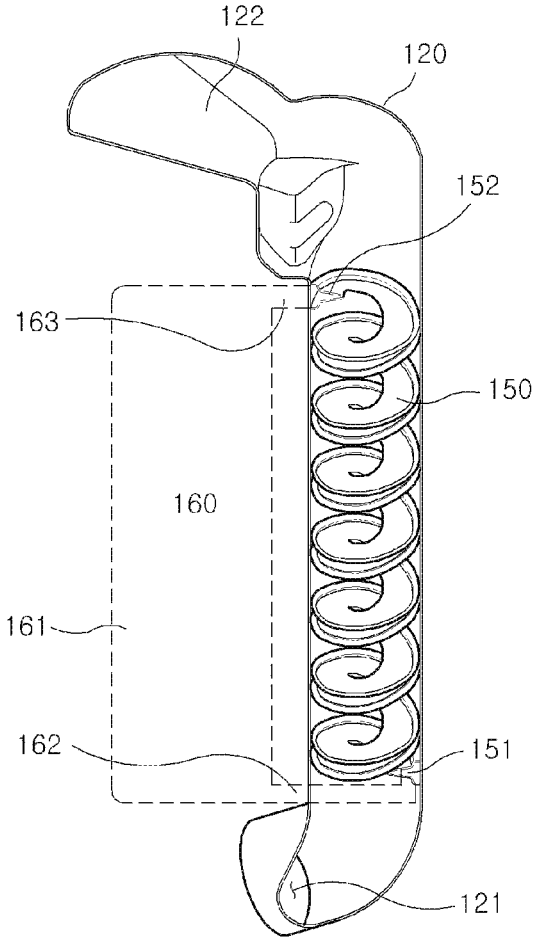
FIG. 6 is a diagram illustrating an exemplary condensing duct coupled to a cooling water storage unit according to an embodiment of the present disclosure.

FIG. 6 is a diagram illustrating an exemplary condensing duct coupled to a cooling water storage unit according to an embodiment of the present disclosure.

Referring to FIG. 6, a cooling water storage unit 160 is installed within the condensing duct 120 and configured to supply cooling water into the rib 150. The cooling water storage unit 160 includes: a storage tank 161 for storing cooling water; a cooling water injection port 162 coupled to the inlet 151 of the rib 150; and a cooling water discharge port 163 coupled to the outlet 152 of the rib 150. The cooling water stored in the storage tank 161 is supplied into the rib 150 through the cooling water injection port 162. The supplied cooling water flows in the cavity 153 and is then discharged out into the storage tank 161 the rib 150 through the cooling water discharge port 163 which is coupled with the outlet 152 of the rib 150.

In this embodiment, the cooling water injection port 162 is disposed on the lower end of the cooling water storage unit 160, and the cooling water discharge port 163 is disposed on an upper end of the cooling water storage unit 160. If the cooling water injection port 162 is located above the cooling water discharge port 163, the cooling water introduced from the cooling water storage unit 160 into the rib 150 would flow downwards from the upper end of the rib 150 toward the lower end. If a flow rate of the cooling water is too low, some region in the cavity 153 may not be filled with the cooling water. As a consequence, heat exchange between the air and the cooling water within the condensing duct 120 may not be adequate. In this embodiment, however, since the cooling water supplied into the cavity 153 of the rib 150 from the cooling water storage unit 160 flows upwards from the lower end of the rib 150 toward the upper end, the entire region of the cavity 153 is filled with the cooling water. Thus, heat exchange between the air and the cooling water within the condensing duct 120 is efficient.

Figure 7:
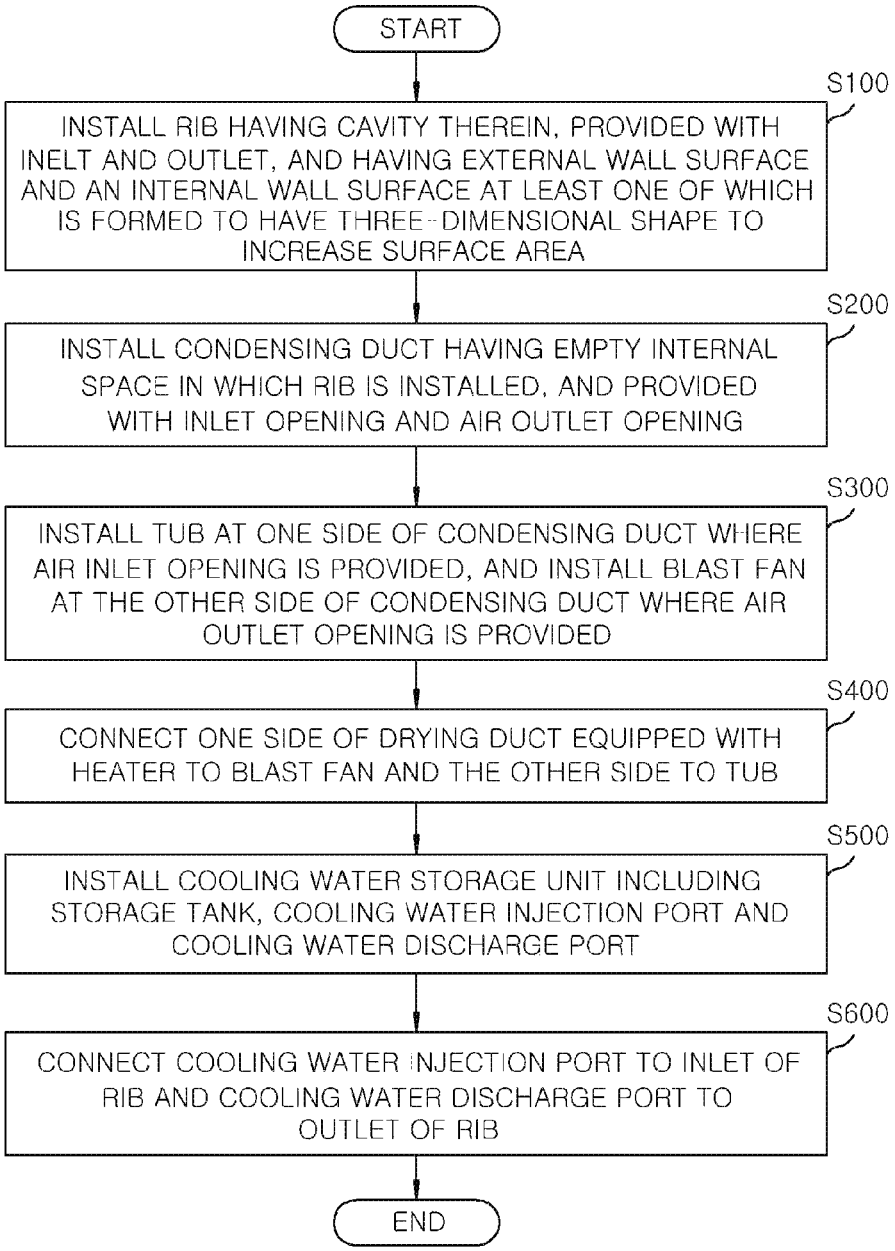
FIG. 7 is a flowchart describing an exemplary manufacturing method of a drying assembly according to an embodiment of the present disclosure.

FIG. 7 is a flowchart for describing an exemplary manufacturing method of a drying assembly according to an embodiment of the present disclosure.

Referring to FIG. 3, FIG. 4 and FIG. 7, the drying assembly 100 has tub 110 and a drum (not shown) for accommodating laundry. The drying assembly 100 includes a condensing duct 120, a blast fan 130, a drying duct 140 and a heater (not shown).

To manufacture the drying assembly 100 according to the exemplary embodiment of the present disclosure, a rib 150 is coupled with an inlet and an outlet used for water to flow into and out from the cavity 153. (S100). The rib has an external wall surface 154 and an internal wall surface 155. At least one the internal surface 155 and the external surface 154 has a three-dimensional pattern that contributes to increased surface area (S100). Then, a condensing duct 120 with the rib 150 disposed inside is installed (S200). The condensing duct 120 includes an air inlet opening 121 through which air is injected, and an air outlet opening 122 through which the air is discharged. Then, the tub 110 is coupled to the condensing duct 120 on the side where the air inlet opening 121 is disposed. The blast fan 130 is installed on the other side of the condensing duct 120 where the air outlet opening 122 is located (S300). Then, one side of the drying duct 140 including the heater (not shown) is coupled to the blast fan 130, and the other end of the drying duct 140 is coupled to the tub 110 (S400).

According to one exemplary embodiment, the rib 150 may have a spiral shape. With this spiral shape, a heat exchange area between cooling water flowing in the cavity 153 of the rib 150 and the air flowing in the internal space of the condensing duct 120 can be increased, so that drying efficiency can be improved. In addition, the spiral shape generates resistance for the air flow on the surface of the rib. As a result, heat exchange is prolonged, which leads to further improvement of drying efficiency.

According to one exemplary embodiment, a drying assembly 100 may further include a cooling water storage unit 160. Referring to FIG. 6, the cooling water storage unit 160 includes a storage tank 161 for storing cooling water therein, a cooling water injection port 162 coupled to an inlet 151 of the rib 150 and a cooling water discharge portion 163 coupled to an outlet 152 of the rib 150.

In addition, the cooling water storage unit 160 is installed (S500). The storage unit 160 includes the storage tank 161, the cooling water injection port 162 and the cooling water discharge port 163. Then, the cooling water injection port 162 is coupled to an inlet 151 of the rib 150, and the cooling water discharge port 163 is coupled to an outlet 152 of the rib 150 (S600). Using this process, the drying assembly 100 according to the present exemplary embodiment can be manufactured.

The exemplary embodiment has been described for the drum type washing machine, for example. However, the exemplary embodiment is not meant to be anyway limiting, and the technical concept of the present disclosure can also be applied to various other apparatuses having a drying function. Thus, the scope of the inventive concept should be defined by the following claims.

Although certain preferred embodiments and methods have been disclosed herein, it will be apparent from the foregoing disclosure to those skilled in the art that variations and modifications of such embodiments and methods may be made without departing from the spirit and scope of the invention. It is intended that the invention shall be limited only to the extent required by the appended claims and the rules and principles of applicable law.

What is claimed is:

1. A drying assembly, comprising:

a tub configured to contain washing water during a washing process;

a condensing duct coupled to the tub and configured to carry air flowing from the tub during a drying process; and a hollow rib disposed inside the condensing duct and configured to carry cooling water for cooling air flowing across the condensing duct, wherein the hollow rib comprises a wall surface that comprises protrusions and depressions arranged in a pattern.

2. The drying assembly of claim 1 further comprising:

a blast fan disposed on one side of the condensing duct for driving air flow from the condensing duct; and a drying duct coupled to the blast fan and the tub and configured to carry air flowing from the condensing duct to the tub.

3. The drying assembly of claim 2 further comprising:

an air inlet opening coupled to the condensing duct, wherein air flows from the tub to the condensing duct through the air inlet opening; and an air outlet opening coupled to the condensing duct, wherein air is discharged from the condensing duct through the air outlet opening.

4. The drying assembly of claim 2 further comprising a heater disposed within the drying duct.

5. The drying assembly of claim 1, wherein the hollow rib has a substantially spiral shape.

6. The drying assembly of claim 1, wherein the hollow rib further comprises a water inlet and a water outlet.

7. The drying assembly of claim 6, further comprising:

a cooling water storage unit comprising a storage tank for storing cooling water;

a cooling water injection port coupled to the water inlet of the hollow rib; and a cooling water discharge port coupled to the water outlet of the hollow rib.

8. The drying assembly of claim 7, wherein the cooling water injection port is disposed at a lower portion of the cooling water storage unit, and the cooling water discharge port is disposed an upper portion of the cooling water storage unit.

9. The drying assembly of claim 3, wherein the air inlet opening is disposed at a lower portion of the condensing duct, and the air outlet opening is disposed at an upper portion of the condensing duct.

10. The drying assembly of claim 1, wherein the pattern comprises one of a wave pattern and a rectangular groove pattern.

11. The drying assembly of claim 1, wherein the wall surface is an external wall surface of the hollow rib.

12. The drying assembly of claim 1, wherein the wall surface is an internal wall surface of the hollow rib.

13. A method for manufacturing a drying assembly, the method comprising:

providing a rib comprising: a water inlet port; an inner wall; and outer wall; a water outlet port; and a water passage for carrying cooling water, wherein at least one of the inner wall and the outer wall comprises protrusions and depressions arranged in a three-dimensional pattern;

installing the rib inside a condensing duct, where a space formed between the rib and the condensing duct is used for carrying air;

coupling an air inlet port and an air outlet port to the condensing duct;

coupling a tub of the drying assembly to the air inlet port;

coupling a blast fan at the air outlet port; and coupling a drying duct the between the blast fan and the tub, wherein the drying duct is configured for carrying air back to the tub, and wherein further the drying duct is coupled to a heater.

14. The method of claim 13, wherein the rib is spiral-shaped.

15. The method of claim 13, wherein the three-dimensional pattern comprises one of a repeated wave pattern and a repeated groove pattern.

16. The method of claim 13 further comprising:

coupling a cooling water injection port of a cooling water storage unit to the water inlet port on the rib; and coupling a cooling water discharge port of the cooling water storage unit to the water outlet port on the rib, wherein the water passage in the rib and the cooling water storage unit are configured to circulate cooling water.

17. A dryer comprising:

a tub configured to contain washing water for use during a washing process; and an air condensing unit configured to reduce air moisture by condensation in a drying process, wherein the air condensing unit comprises an outer tube, and an inner tube disposed within the outer tube, wherein the inner tube is configured to carry cooling water, and wherein further a space between the outer tube and the inner tube is configured to carry air flowing from the tub, wherein the inner tube comprises an inner wall and an outer wall, and wherein further at least one of the inner wall and the outer wall comprises protrusions and depressions arranged in a three-dimensional pattern.

18. The dryer of claim 17, wherein the inner tube is a hollow rib and coupled to a water inlet port and a water outlet port.

19. The dryer of claim 17 further comprising:

a cooling water storage unit coupled to the inner tube;

a drying duct coupled between the tub and the outer tube and configured to carry air flowing from the outer tube to the tub;

a heater disposed inside the drying duct; and a fan coupled to the outer tube for drawing air from the outer tube to the drying duct.

20. The dryer of claim 17, wherein the three-dimensional pattern comprises one of a repeated wave pattern and a repeated rectangular groove pattern.

* * * * *